US009113762B2

(12) United States Patent
Ohnishi et al.

(10) Patent No.: US 9,113,762 B2
(45) Date of Patent: Aug. 25, 2015

(54) CLEANING ROBOT

(75) Inventors: Yuhji Ohnishi, Osaka (JP); Jitsuo Sakamoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/239,343

(22) PCT Filed: Aug. 17, 2012

(86) PCT No.: PCT/JP2012/070893

§ 371 (c)(1),
(2), (4) Date: Feb. 18, 2014

(87) PCT Pub. No.: WO2013/046994

PCT Pub. Date: Apr. 4, 2013

(65) Prior Publication Data

US 2014/0189976 A1 Jul. 10, 2014

(30) Foreign Application Priority Data

Sep. 29, 2011 (JP) ..... 2011-214455

(51) Int. Cl.

| | |
|---|---|
| ***A47L 5/00*** | (2006.01) |
| ***A47L 9/00*** | (2006.01) |
| ***A47L 9/28*** | (2006.01) |
| ***A47L 7/04*** | (2006.01) |

(52) U.S. Cl.

CPC ..... *A47L 9/0081* (2013.01); *A47L 7/04* (2013.01); *A47L 9/2873* (2013.01); *A47L 2201/02* (2013.01)

(58) Field of Classification Search

CPC ..... A47L 9/0081; A47L 7/04; A47L 9/2873; A47L 2201/02

USPC ..... 15/319, 339, 340.1, 340.3, 1.51, 320, 15/DIG. 1

IPC ..... A47L 5/00

See application file for complete search history.

(56) References Cited

U.S. PATENT DOCUMENTS

| | | | | |
|---|---|---|---|---|
| 2003/0140444 | A1 * | 7/2003 | Soejima et al. | 15/327.2 |
| 2005/0022331 | A1 | 2/2005 | Kim et al. | |
| 2005/0066635 | A1 | 3/2005 | Genn et al. | |

FOREIGN PATENT DOCUMENTS

| | | | |
|---|---|---|---|
| CN | 1833593 | A | 9/2006 |
| JP | 2005-046616 | A | 2/2005 |
| JP | 2005-516712 | A | 6/2005 |
| JP | 2007-275361 | A | 10/2007 |
| JP | 2007-325701 | A | 12/2007 |
| JP | 4268911 | B2 | 5/2009 |

OTHER PUBLICATIONS

Official Communication issued in International Patent Application No. PCT/JP2012/070893, mailed on Nov. 20, 2012.

* cited by examiner

*Primary Examiner* — David Redding
(74) *Attorney, Agent, or Firm* — Keating & Bennett, LLP

(57) ABSTRACT

A cleaning robot that discharges, upwards and from an exhaust port (7), airflow having dust removed therefrom, and comprises: a main case (2) having a suction port (6) opened in the bottom surface thereof and the exhaust port (7) opened in the upper surface thereof, and that is self-propelled on a floor surface (F); an electric fan (22) arranged inside the main case (2); and a dust collection unit (30) that collects dust in airflow sucked in from the suction port (6) by the driving force of the electric fan (22).

4 Claims, 5 Drawing Sheets

CLEANING ROBOT

TECHNICAL FIELD

The present invention relates to a cleaning robot that moves by itself on a floor surface.

BACKGROUND ART

A conventional cleaning robot is disclosed in a patent document 1. In this cleaning robot, a main body housing, which has a circular shape when viewed from top, is provided with a drive wheel and moves by itself on a floor surface to perform cleaning. Here, to perform cleaning under a table and the like, the main body housing is formed to have a thin shape that is low. A suction opening is opened through a lower surface of the main body housing, and a circumferential surface of the main body housing is provided with an air exhaling opening that is opened backward with respect to a traveling direction during a cleaning time. The main body housing is provided therein with an electric fan and a dust collection portion.

Besides, the main body housing is provided therein with an ion generation apparatus that generates ions. The ion generation apparatus emits the ions into a duct that communicates with an exhaust opening which is opened through the circumferential surface of the main body housing. The ions are sent out from the exhaust opening by diving of an ion fan disposed in the duct.

In the cleaning robot having the above structure, when a cleaning operation is started, the drive wheel and the electric fan are driven. The main body housing moves by itself on a floor surface by rotation of the drive wheel, and an air flow containing dust is sucked from the suction opening by the electric fan. The dust contained in the air flow is collected by the dust collection portion, and the air flow, from which the dust is removed, passes through the electric fan to be exhaled backward from the air exhaling opening provided through the circumferential surface.

Besides, when the ion generation apparatus and the ion fan are driven, the ions are sent out from the exhaust opening, so that it is possible to perform germ removal and deodorization of a room.

CITATION LIST

Patent Literature

PLT1: JP-A-2005-46616 (pages 4 to 8, FIG. 4)

SUMMARY OF INVENTION

Technical Problem

However, according to the conventional cleaning robot, the air exhaling opening and the exhaust opening are opened through the circumferential surface of the main body housing; accordingly, the dust on the floor surface is stirred up into the air by the air flow sent out from the air exhaling opening and the exhaust opening. Especially, the main body housing is formed to have the thin shape; accordingly, the air exhaling opening and the exhaust opening come close to the floor surface, so that the amount of the dust stirred up increases. Because of this, there is a problem that the dust stirred up stays in the air and air cleanliness degree of the room deteriorates.

It is an object of the present invention to provide a cleaning robot that is able to prevent dust on a floor surface from being stirred up and to improve a cleanliness degree of a room.

Solution to Problem

To achieve the above object, the present invention is featured in that a cleaning robot comprises: a main body housing whose lower surface is provided with a suction opening and whose upper surface is provided with an air exhaling opening, and which moves by itself on a floor surface; an electric fan that is disposed in the main body housing; and a dust collection portion that collects dust in an air flow sucked from the suction opening by driving of the electric fan, wherein the air flow, from which the dust is removed, is exhaled upward from the air exhaling opening.

According to this structure, when the main body housing moves by itself on the floor surface and the electric fan is driven, an air flow containing dust on the floor surface is sucked from the suction opening opened through the lower surface of the main body housing. The dust contained in the air flow is collected by the dust collection portion. The air flow, from which the dust is removed by the dust collection portion, passes through the electric fan to be exhaled upward from the air exhaling opening opened through the upper surface of the main body housing.

Besides, the cleaning robot having the above structure according to the present invention is featured to dispose the air exhaling opening through a front portion of the main body housing that is situated in front in a moving direction during a cleaning time, and to exhale the air flow obliquely backward from the air exhaling opening. According to this structure, during the cleaning time, the main body housing moves with the air exhaling opening disposed in front and the air flow is exhaled from the air exhaling opening backward in an oblique direction. In this way, the air flow exhaled from the air exhaling opening at a rear end of the main body housing goes away from the floor surface.

Besides, the cleaning robot having the above structure according to the present invention has a feature in which the dust collection portion is provided, through a front surface thereof, with a flow-in opening for the air flow that communicates with the suction opening and a flow-out opening for the air flow that communicates with the electric fan, wherein the suction opening, the electric fan and the air exhaling opening are disposed in front of the dust collection portion.

According to this structure, the air flow sucked from the suction opening flows into the dust collection portion via the flow-in opening disposed through the front surface. The air flow, from which the dust is removed by the dust collection portion, flows out via the flow-out opening disposed through the front surface. The air flow flowing out from the dust collection portion passes through the electric fan to be exhaled via the air exhaling opening disposed through the front portion of the main body housing.

Besides, the cleaning robot having the above structure according to the present invention is featured to comprise an ion generation apparatus for emitting ions that is disposed in a flow path between the electric fan and the air exhaling opening. According to this structure, when the ion generation apparatus is driven while the main body housing is moving, an air flow containing ions is sent out from the air exhaling opening. In this way, the ions spread throughout a room to perform germ removal and deodorization of the room.

Besides, the cleaning robot having the above structure according to the present invention is featured to comprise a charge stand to which the main body housing returns to charge a battery disposed in the main body housing, wherein the air flow containing the ions is able to be sent out from the air exhaling opening toward the charge stand by driving of the ion generation apparatus and electric fan in a returning state of the main body housing.

According to this structure, when the cleaning ends, the man body hosing returns to the charge stand to charge the battery in the main body housing. Usually, the charge stand is disposed along a side wall of a room. During the charge or when the charge ends, if the ion generation apparatus and the electric fan are driven, the air flow containing the ions is sent out from the air exhaling opening toward the charge stand in an oblique direction. The air flow containing the ions ascends along the side wall of the room and flows along a ceiling wall and side walls opposite to each other. In this way, the air flow containing the ions spreads throughout the room.

Advantageous Effects of Invention

According to the present invention, an air flow is exhaled upward from the air exhaling opening disposed through the upper surface of the main body housing; accordingly, it is possible to prevent dust on a floor surface from being stirred up and to improve cleanliness degree of a room.

DESCRIPTION OF EMBODIMENTS

Figure 1:
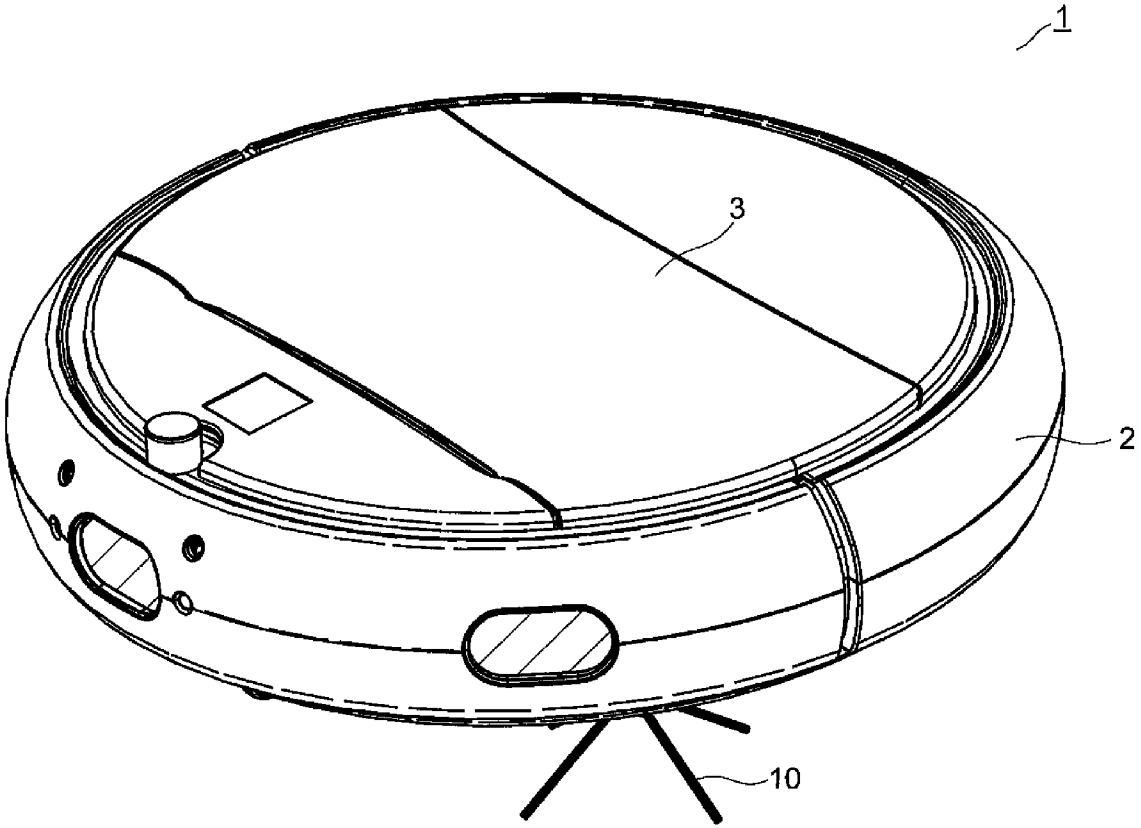
FIG. 1 is a perspective view showing a cleaning robot according to an embodiment of the present invention.

Hereinafter, an embodiment of the present invention is described with reference to the drawings. FIG. 1 is a perspective view showing a cleaning robot according to an embodiment. A cleaning robot 1 has a main body housing 2 that has a circular shape when viewed from top and drives drive wheels 29 by means of a battery 14 (see FIG. 2 as to both) to move by itself. An upper surface of the main body housing 2 is provided with a cover portion 3 that is opened and closed when a dust collection portion 30 (see FIG. 2) is put in and taken out.

Figure 2:
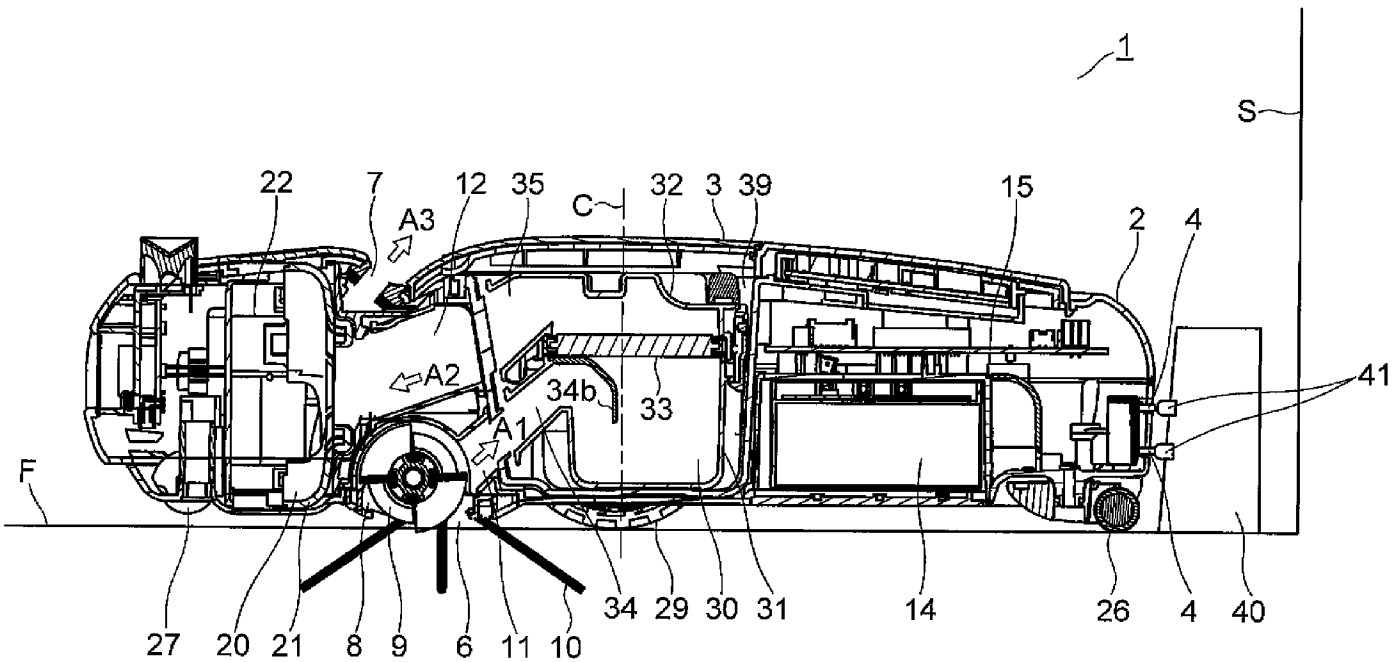
FIG. 2 is a side sectional view showing the cleaning robot according to the embodiment of the present invention.

FIG. 2 shows a side sectional view of the cleaning robot 1. The main body housing 2 is provided with a pair of drive wheels 29 that protrude from a bottom surface. A rotary shaft of the drive wheel 29 is disposed on a center line C of the main body housing 2. When both drive wheels 29 rotate in the same direction, the main body housing 2 moves forward and backward, and when both rotate in directions opposite to each other, the main body housing 2 rotates about the center line C.

A suction opening 6 is disposed through a lower surface of a front portion of the main body housing 2 that is situated in front in a moving direction when cleaning is performed. The suction opening 6 is formed to oppose a floor surface F by means of an open surface of a recessed portion 8 that is formed to be recessed on the bottom surface of the main body housing 2. A rotary brush 9, which rotates on a horizontal rotary shaft, is disposed in the recessed portion 8, and side brushes 10, each of which rotates on a vertical rotary shaft, are disposed on both sides of the recessed portion 8.

A roller-shaped front wheel 27 is disposed in front of the recessed portion 8. A rear end of the main body housing 2 is provided with a rear wheel 26 that includes a caster. As described later, in the main body housing 2, a weight is dispersed in a back-forth direction with respect to the drive wheel 29 disposed at the center, so that the front wheel 27 goes away from the floor surface F, while the rotary brush 9, the drive wheels 29 and the rear wheel 26 contact the floor surface F to perform the cleaning. The front wheel 27 moves onto a step that appears on a traveling path, so that the main body housing 2 can easily go over the step.

A rear end of a circumferential surface of the main body housing 2 is provided with a charge terminal 4 for charging the battery 14. The main body housing 2 moves by itself to return to a charge stand 40 installed in a room, and the charge terminal 4 comes into contact with a terminal portion 41 disposed on the charge stand 40 to charge the battery 14. The charge stand 40 connected to a commercial power supply is usually installed along a side wall S of the room.

The main body housing 2 is provided therein with the dust collection portion 30 that collects dust. The dust collection portion 30 is housed in a dust collection chamber 39 that is disposed in the main body housing 2. The dust collection chamber 39 forms an isolated chamber whose circumferential surfaces in four directions and bottom surface are covered, while the remaining surfaces except for a front wall are closed. The dust collection chamber 39 is provided, through the front wall thereof, with a first air inhaling path 11 that communicates with the recessed portion 8 and a second air inhaling path 12 that is disposed over the recessed portion 8 and communicates with a motor unit 20 described later.

Figure 3:
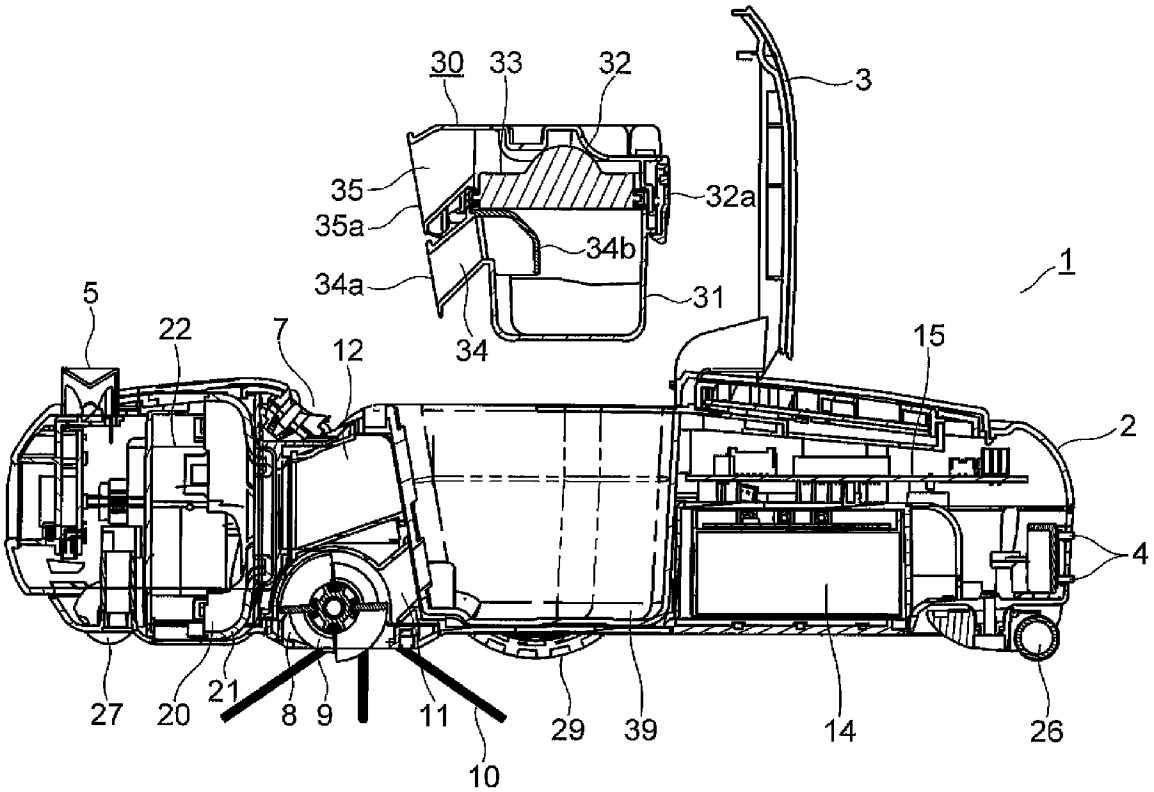
FIG. 3 is a side sectional view showing a state in which a dust collection portion of the cleaning robot according to the embodiment of the present invention is removed.
Figure 4:
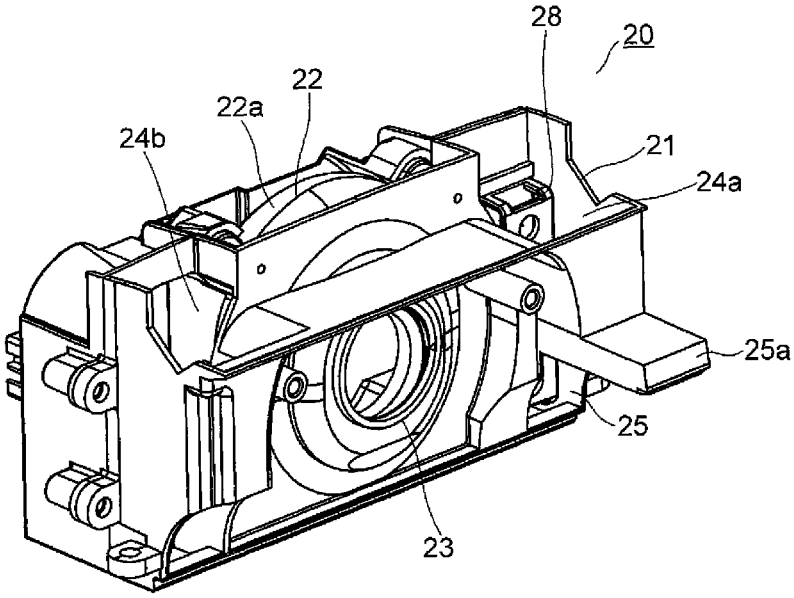
FIG. 4 is a perspective view showing a motor unit of a cleaning robot according to the embodiment of the present invention.
Figure 5:
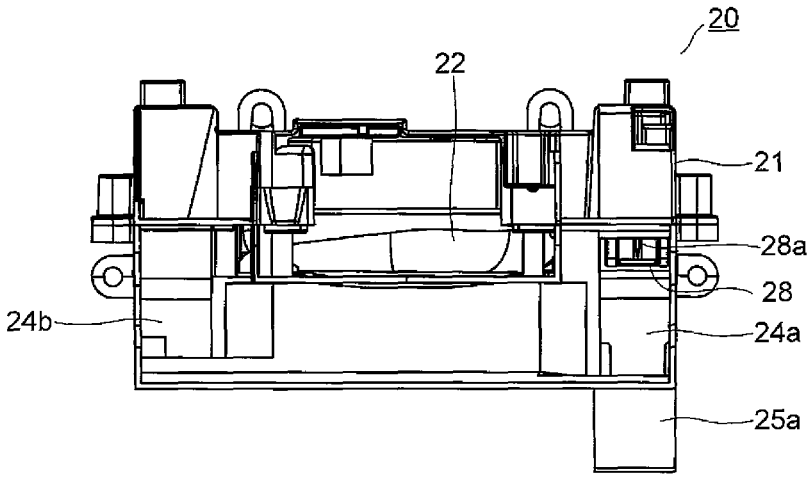
FIG. 5 is a front view showing the motor unit of the cleaning robot according to an embodiment of the present invention.
Figure 6:
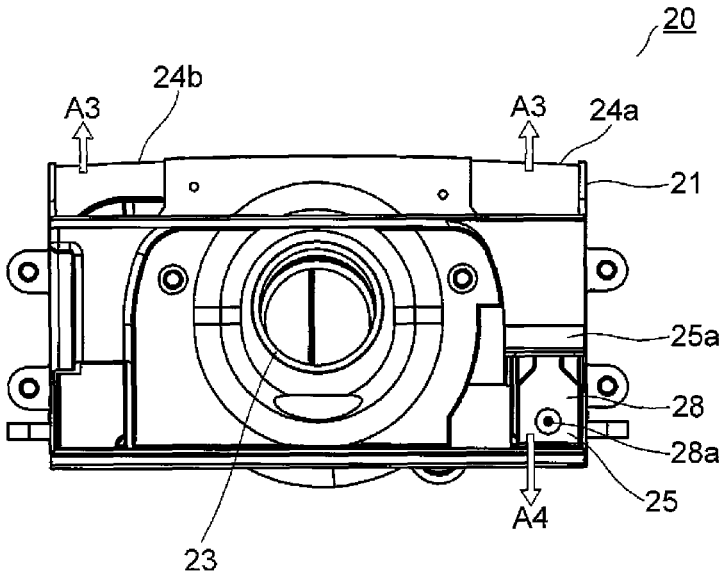
FIG. 6 is a top view showing the motor unit of the cleaning robot according to the embodiment of the present invention.
Figure 7:
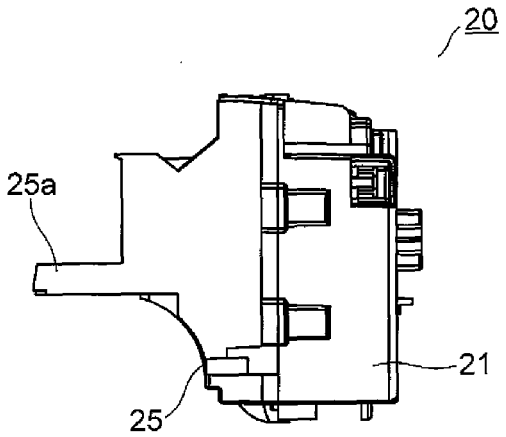
FIG. 7 is a side view showing the motor unit of the cleaning robot according to the embodiment of the present invention.

The dust collection portion 30 is disposed on the center line C of the main body housing 2, and can be put into and taken out with the lid portion 3 of the main body housing 2 opened as shown in FIG. 3. The dust collection portion 30 is provided with an upper cover 32 that has a filter 33 on an upper surface of a dust collection vessel 31 that is cylindrical shape having bottom. The upper cover 32 engages with the dust collection vessel 31 by means of a movable engagement portion 32*a*, and can be taken out from the dust collection vessel 31 by operation of the engagement portion 32*a*. In this way, it is possible to dump the dust accumulated in the dust collection vessel 31.

The dust collection vessel 31 is provided, through a circumferential surface thereof, with a flow-in path 34 whose tip end has a flow-in opening 34*a* to communicate with the first air inhaling path 11. The dust collection vessel 31 is provided therein with a flow-in portion 34*b* that communicates with the flow-in path 34 to guide an air flow downward by means of a bend. The upper cover 32 is provided, through a circumferential surface thereof, with a flow-out path 35 whose tip end is equipped with a flow-out opening 35*a* to communicate with the second air inhaling path 12.

The flow-in opening 34*a* and the flow-out opening 35*a* are provided, around them, with a packing (not shown) which comes into tight contact with the front wall of the dust collection chamber 39. In this way, the dust collection chamber 39 housing the dust collection portion 30 is tightly closed. The front wall of the dust collection chamber 39 is formed to have an inclined surface which can prevent the packing from being deteriorated by sliding when the dust collection portion 30 is put in and taken out.

A control board 15 is disposed in an upper portion behind the dust collection chamber 39 in the main body housing 2. The control board 15 is provided with a control circuit that controls each portion of the cleaning robot 1. The battery 14 freely mountable and demountable is disposed in a lower portion behind the dust collection chamber 39. The battery 14 is charged by the charge stand 40 via the charge terminals 4 and supplies electric power to each portion of the control board 15, the drive wheel 29, the rotary brush 9, the side brush 10, the electric fan 22 and the like.

The motor unit 20 is disposed in a front portion of the main body housing 2. FIG. 4, FIG. 5, FIG. 6, and FIG. 7 show a perspective view, top view, front view, and side view of the motor unit 20, respectively. The motor unit 20 includes a housing 21 formed of a resin and the electric fan 22 housed in the housing 21. The electric fan 22 is formed of a turbo-fan that is covered by a motor case 22*a*.

The motor case 22*a* of the electric fan 22 is provided, through one end in a shaft direction thereof, with an air inhaling opening (not shown) and provided, through a circumferential surface thereof, with two air exhaling openings (not shown). The housing 21 is provided, through a front surface thereof, with an opening portion 23 that opposes the air inhaling opening of the motor case 22*a*. The electric fan 22 of the housing 21 is provided, on both sides thereof, with a first air exhaling path 24*a* and a second air exhaling path 24*b* that communicate with the air exhaling openings of the motor case 22*a*, respectively. The first and second air exhaling paths 24*a*, 24*b* communicate with an air exhaling opening 7 (see FIG. 2) provided through the upper surface of the main body housing 2.

In this way, the air flow paths including the electric fan 22 are gathered in front of the dust collection chamber 39 and disposed in the front portion of the main body housing 2. Because of this, the control board 15 and the battery 14 are gathered behind the dust collection chamber 39 and disposed in the rear portion of the main body housing 2, so that it is possible to achieve size reduction of the main body housing 2 by reducing wirings and the like. Besides, the air flow paths are far from the control board 15; accordingly, even if the air flow leaks, it is possible to alleviate dust adhering to the control board 15 and to reduce malfunction of the control circuit.

Besides, the very heavy electric fan 22 and battery 14 are dispersed and disposed in the front and rear portions of the main body housing 2; accordingly, the weight is distributed with good balance in a back-forth direction of the main body housing 2. Because of this, the rotary brush 9, the drive wheel 29 and the rear wheel 26 grip the floor surface and the main body housing 2 moves back and forth; and even if the rotary brush 9 or the rear wheel 26 loses its foothold because of a step or the like, it is possible to prevent the main body housing 2 from falling.

Here, the dust collection portion 30 is disposed on the center line C; accordingly, even if the weight of the dust collection portion 30 changes because of the collecting and dumping of dust, it is possible to keep the weight balance of the main body housing 2. In the meantime, the weight of the electric fan 22 is large; accordingly, it is possible to achieve a better weight balance by disposing the control board 15 and the battery 14 in the rear portion of the main body housing 2.

The first air exhaling path 24*a* is provided with an ion generation apparatus 28 that has a pair of electrodes 28*a*. A voltage having an a.c. waveform or an impulse waveform is applied to the electrode 28*a*, and ions generated by corona discharge from the electrode 28*a* are emitted into the first air exhaling path 24*a*.

A positive voltage is applied to one electrode 28*a*, so that hydrogen ions due to the corona discharge combine with moisture in the air to generate positive ions formed mainly of $H^+(H_2O)_m$. A negative voltage is applied to the other electrode 28*a*, so that oxygen ions due to the corona discharge combine with moisture in the air to generate negative ions formed mainly of $O_2^-(H_2O)_n$. Here, m, n are each an arbitrary natural number. $H^+(H_2O)_m$ and $O_2^-(H_2O)_n$ agglutinate on surfaces of floating germs and odor components in the air to capture them.

And as indicated by formulas (1) to (3), [.OH] (hydroxyl radical) and $H_2O_2$ (hydrogen peroxide), which are active species, are made to agglutinate and occur on surfaces of microbes and the like by means of collision to break the floating germs and odor components. Here, m', n' are each an arbitrary natural number. Accordingly, by generating the positive ions and negative ions and sending them out from the air exhaling opening 7 (see FIG. 2), it is possible to perform the germ removal and deodorization of the room.

$$H^+(H_2O)_m+O_2^-(H_2O)_n \rightarrow .OH+\tfrac{1}{2}O_2+(m+n)H_2O \quad (1)$$

$$H^+(H_2O)_m+H^+(H_2O)_{m'}+O_2^-(H_2O)_n+O_2^-(H_2O)_{n'} \rightarrow 2.OH+O_2+(m+m'+n+n')H_2O \quad (2)$$

$$H^+(H_2O)_m+H^+(H_2O)_{m'}+O_2^-(H_2O)_n+O_2^-(H_2O)_{n'} \rightarrow H_2O_2+O_2+(m+m'+n+n')H_2O \quad (3)$$

Besides, a lower portion of the first air exhaling path 24*a* is provided with a return opening 25 whose front surface is opened. An upper portion of the return opening 25 is covered by a protrusion portion 25*a* that protrudes from a front surface of the housing 21, and an open surface is formed to be a curved surface along a wall surface of the recessed portion 8 (see FIG. 2). In this way, the return opening 25 is opened to the recessed portion 8 via a hole portion (not shown) disposed through the wall surface of the recessed portion 8, so that a portion of the air flow, which flows in the first air exhaling path 24*a* and contains ions, is guided to the air inhaling side.

In the cleaning robot 1 having the above structure, when a cleaning operation is instructed, the electric fan 22, the ion generation apparatus 28, the drive wheel 29, the rotary brush 9, and the side brush 10 are driven. In this way, the rotary brush 9, the drive wheel 29, and the rear wheel 26 are driven on the floor surface F and the main body housing 2 moves by itself in a predetermined area, so that the air flow containing dust on the floor surface F is sucked from the suction opening 6. At this time, the dust on the floor surface F is stirred up and guided into the recessed portion 8 because of rotation of the rotary brush 9. Besides, dust on both sides of the suction opening 6 is guided into the suction opening 6 because of rotation of the side brush 10.

The air flow sucked from the suction opening 6 flows backward in the first air inhaling path 11 as shown by an arrow A1 and flows into the dust collection portion 30 via the flow-in opening 34*a*. The air flow flowing into the dust collection portion 30 has the dust captured by the filter 33 and flows out from the dust collection portion 30 via the flow-out opening 35*a*. In this way, the dust is collected and accumulated in the dust collection vessel 31. The air flow flowing out from the dust collection portion 30 flows forward in the second air inhaling path 12 as indicated by an arrow A2 and flows into the electric fan 22 of the motor unit 20 via the opening portion 23.

The air flow passing through the electric fan 22 flows in the first air exhaling path 24*a* and the second air exhaling path

24*b*, and the air flow flowing in the first air exhaling path 24*a* contains ions. And the air flow containing the ions is exhaled upward and backward in an oblique direction as indicated by an arrow A3 from the air exhaling opening 7 disposed through the upper surface of the main body housing 2. In this way, the room is cleaned, and the ions, contained in the exhaled air from the main body housing 2 moving by itself, spread throughout the room to perform the germ removal and deodorization of the room. At this time, the air flow is exhaled upward from the air exhaling opening 7; accordingly, it is possible to prevent the dust on the floor surface F from being stirred up and to improve the cleanliness degree of the room.

A portion of the air flow flowing in the first air exhaling path 24*a* is guided to the recessed portion 8 via the return opening 25 as indicated by an arrow A4. Because of this, the air flow guided from the suction opening 6 to the first air inhaling path 11 contains ions. In this way, it is possible to perform the germ removal and deodorization of the dust collection vessel 31 and filter 33 of the dust collection portion 30.

Besides, when both drive wheels 29 rotate in directions opposite to each other, the main body housing 2 rotates about the center line C to change its direction. In this way, it is possible to make the main body housing 2 move by itself in an entire desired area and move by itself avoiding an obstacle. In the meantime, it is also possible to make the main body housing 2 move backward by rotating backward both drive wheels 29 that are rotating forward so far.

When the cleaning ends, the main body housing 2 moves by itself and returns to the charge stand 40. In this way, the charge terminals 4 come into contact with the terminal portions 41 to charge the battery 14.

Besides, by setting, when the main body housing 2 is in a return state, it is possible to drive the electric fan 22 and the ion generation apparatus 28 during the charge and after the charge ends. In this way, the air flow containing the ions is sent out upward and backward from the air exhaling opening 7. The charge terminals 4 are disposed at the rear end of the main body housing 2; accordingly, the air flow containing the ions flows toward the charge stand 40 and ascends along the side wall S. This air flow flows along a ceiling wall and side walls opposite to each other of the room. Accordingly, the ions spread throughout the room and can improve the germ removal and deodorization effects.

According to the present embodiment, the air flow is exhaled upward from the air exhaling opening 7 disposed through the upper surface of the main body housing 2; accordingly, it is possible to prevent the dust on the floor surface F from being stirred up and to improve the cleanliness degree of the room.

Besides, the air exhaling opening 7 is disposed through the front portion of the main body housing 2 and the air flow is exhaled obliquely backward from the air exhaling opening 7; accordingly, the exhaled air flow goes away from the floor surface F at the rear end of the main body housing 2 and flows. In this way, it is possible to surely prevent the dust on the floor surface F from being stirred up. Besides, for example, if the air flow is exhaled forward in a traveling direction, when the main body housing 2 goes under low furniture such as a bed that is low, the dust in front is stirred up by the exhaled air flow and scattered. Accordingly, by exhaling the air flow obliquely backward, it is possible to prevent the dust in front from being stirred up.

Besides, the dust collection portion 30 has the flow-in path 34*a* and flow-out path 35*a* disposed through the front surface, while the suction opening 6, the electric fan 22, and the air exhaling opening 7 are disposed in front of the dust collection portion 30; accordingly, it is possible to easily dispose the air exhaling opening 7 through the front portion of the main body housing 2.

Besides, the ion generation apparatus 28 for emitting the ions is disposed in the first air exhaling path 24*a* between the electric fan 22 and the air exhaling opening 7; accordingly, it is possible to send out the ions from the air exhaling opening 7 into the room to perform the germ removal and deodorization of the room.

Besides, in the return state in which the main body housing 2 returns to the charge stand 40, it is possible to send out the air flow containing the ions from the air exhaling opening 7 toward the charge stand 40 by driving the ion generation apparatus 28 and the electric fan 22. Usually, the charge stand 40 is disposed along the side wall S of the room, and in this way, the air flow containing the ions flows along the side wall S, ceiling wall, and side walls opposite to each other of the room. Accordingly, the ions spread throughout the room and can improve the germ removal and deodorization effects.

INDUSTRIAL APPLICABILITY

The present invention is usable for a cleaning robot that moves by itself on a floor surface.

REFERENCE SIGNS LIST

1 cleaning robot
2 main body housing
3 lid portion
4 charge terminal
6 suction opening
7 air exhaling opening
8 recessed portion
9 rotary brush
10 side brush
11 first air inhaling path
12 second air inhaling path
14 battery
15 control board
20 motor unit
21 housing
22 electric fan
23 opening portion
24*a* first air exhaling path
24*b* second air exhaling path
25 return opening
28 ion generation apparatus
29 drive wheel
30 dust collection portion
31 dust collection vessel
32 upper cover
33 filter
34 flow-in path
35 flow-out path
40 charge stand
41 terminal portion

The invention claimed is:

1. A cleaning robot comprising:

a main body housing whose lower surface is provided with a suction opening and whose upper surface is provided with an air exhaling opening, and which moves by itself on a floor surface;

an electric fan that is disposed in the main body housing; and a dust collection portion that collects dust in an air flow sucked from the suction opening by driving of the electric fan; wherein the air flow, from which the dust is removed, is exhaled upward from the air exhaling opening; and the air exhaling opening is disposed through a front portion of the main body housing that is situated in front in a moving direction during a cleaning time, and the air flow is exhaled obliquely backward from the air exhaling opening.

2. The cleaning robot according to claim 1, wherein the dust collection portion is provided, through a front surface thereof, with a flow-in opening for the air flow that communicates with the suction opening and a flow-out opening for the air flow that communicates with the electric fan, wherein the suction opening, the electric fan and the air exhaling opening are disposed in front of the dust collection portion.

3. The cleaning robot according to claim 1, further comprising an ion generation apparatus for emitting ions that is disposed in a flow path between the electric fan and the air exhaling opening.

4. The cleaning robot according to claim 3, further comprising:

a charge stand to which the main body housing returns to charge a battery disposed in the main body housing, wherein an air flow containing the ions is able to be sent out from the air exhaling opening toward the charge stand by driving of the ion generation apparatus and electric fan in a returning state of the main body housing.

* * * * *